US006865987B2

(12) United States Patent
Koyanagi et al.

(10) Patent No.: US 6,865,987 B2
(45) Date of Patent: Mar. 15, 2005

(54) SHEET-SHAPED MATERIAL POSITIONING DEVICE AND PRINTING PLATE PRECURSOR EXPOSURE DEVICE

(75) Inventors: Yoshihiro Koyanagi, Kanagawa (JP); Akihiro Hashiguchi, Kanagawa (JP); Kazuhisa Okamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/389,936

(22) Filed: Mar. 18, 2003

(65) Prior Publication Data

US 2004/0020386 A1 Feb. 5, 2004

(30) Foreign Application Priority Data

Mar. 27, 2002 (JP) ..... 2002-089299

(51) Int. Cl.[7] ..... B41L 47/14
(52) U.S. Cl. ..... 101/477
(58) Field of Search ..... 101/477, 481, 101/DIG. 36, 415.1, 216, 378, 382.1

(56) References Cited

U.S. PATENT DOCUMENTS 5,440,988 A * 8/1995 Ito ..... 101/477
6,295,929 B1 * 10/2001 Tice et al. ..... 101/477
6,604,465 B2 * 8/2003 Tice et al. ..... 101/415.1
2002/0011164 A1 1/2002 Dodge et al.

FOREIGN PATENT DOCUMENTS

DE 3129418 A 3/1983

* cited by examiner

*Primary Examiner*—Eugene H. Eickholt
(74) *Attorney, Agent, or Firm*—Taiyo, Nakajima & Kato

(57) ABSTRACT

A device for positioning a sheet-shaped material by providing a plurality of pairs of pins on a conveying path. Printing plate precursors are classified, on the basis of widths thereof, into large-sized and small-sized. Two pairs of positioning pins are provided for each size, and are disposed so as to be offset in a direction of conveying a printing plate precursor toward a rotating drum. A width of a small-sized printing plate precursor is smaller than a pitch dimension of a pair of positioning pins for large-sized printing plate precursors. Therefore, the small-sized printing plate precursor abuts and is positioned by positioning pins for small-sized printing plate precursors which are provided further ahead. Moreover, a large-sized printing plate precursor directly abuts and is positioned by the positioning pins for large-sized printing plate precursors, so as not to be interfered with by the positioning pins for small-sized printing plate precursors.

14 Claims, 10 Drawing Sheets

SHEET-SHAPED MATERIAL POSITIONING DEVICE AND PRINTING PLATE PRECURSOR EXPOSURE DEVICE

BACKGROUND OF THE INVENTION

1. Field of the Invention

The present invention relates to a sheet-shaped material positioning device which, by conveying a sheet-shaped material and making a conveying direction leading end portion of the sheet-shaped material abut a pair of positioning pins, corrects the conveying direction position and the tilting with respect to the conveying direction (i.e., the rotational direction in the plane of the sheet-shaped material), so as to position the sheet-shaped material at a predetermined position.

2. Description of the Related Art

Techniques (and printing plate precursor exposure devices) have been developed which utilize a sheet-shaped material (and, in particular, a printing plate precursor) in which an image recording layer is provided on a support), and which directly record an image onto the image recording layer of the printing plate precursor by using a laser beam or the like. With such a technique, an image can be rapidly recorded onto a printing plate precursor. The term printing plate precursor encompasses photopolymer printing plate precursors, thermal type printing plate precursors, silver salt diffusion transfer type printing plate precursors, and the like.

In an automatic printing plate precursor exposure device using the technique of recording an image onto a printing plate precursor, while rotating a rotating drum at high speed (main scanning) in a state in which a printing plate precursor is trained around the peripheral surface of the rotating drum, an exposure head is moved along the axial direction of the rotating drum (subscanning). An image is thereby recorded on the printing plate precursor.

Among this type of automatic printing plate precursor exposure device, there are those in which one end of the printing plate precursor is fixed to the rotating drum by a clamp mechanism having opening/closing type chucks which are fixed to the rotating drum or which are provided so as to be able to be attached to and removed from the rotating drum.

In this clamp mechanism, the chucks are set in an open state (a state in which a gap is formed between the chucks and the rotating drum), and the printing plate precursor is inserted in from a direction tangential to the rotating drum. At the point in time when the printing plate precursor is positioned at a predetermined position, the chucks are set in a closed state (a state in which the chucks and the rotating drum nip the printing plate precursor). The printing plate precursor is thereby held.

Thereafter, while rotating the rotating drum, the printing plate precursor is trained onto the peripheral surface of the rotating drum. Finally, by holding the training direction trailing end portion by chucks for the trailing end, the printing plate precursor can be positioned at a predetermined position on the rotating drum.

In holding the printing plate precursor by the chucks in this way, the printing plate precursor must be positioned precisely. Thus, conventionally, a pair of positioning pins, which are commonly used for printing plate precursor of all sizes (printing plate precursors of all transverse direction dimensions), are projected out on the rotating drum, and the printing plate precursor is conveyed along a guide toward the pair of positioning pins.

Due to the printing plate precursor abutting a positioning member (the pair of positioning pins or a plate for positioning or the like) while being conveyed, the conveying direction position and the tilting of the printing plate precursor are corrected. Moreover, while this state is maintained, by conveying the printing plate precursor in the transverse direction and making the printing plate precursor abut a positioning pin for transverse direction abutment, the center of the printing plate precursor can be made to correspond with, for example, the axial direction center of the rotating drum. Note that this positioning in the transverse direction may be carried out by using one end portion of the printing plate precursor as a reference.

At the point in time when the above-described positioning is completed, the printing plate precursor is held by the chucks, and can be precisely trained around the rotating drum.

However, because the positioning members for the conveying direction correspond to all sizes of printing plate precursors, these positioning members are disposed at an interval (pitch) such that they abut even the smallest sized printing plate precursor at two points. Thus, when the largest sized printing plate precursor is conveyed, the ratio of the interval (pitch) of the pair of positioning pins with respect to the width of the large-sized printing plate precursor is small. It is easy for the printing plate precursor to shake, and there are cases in which the printing plate precursor cannot be positioned accurately with respect to the conveying direction.

FIG. 9 illustrates an experimental example at the time of positioning a large-sized printing plate precursor 200 whose width is 1160 mm, by a pair of positioning pins 202 whose pitch dimension is 380 mm. The pitch dimension of the positioning pins 202 is set so as to be able to correspond to the width (400 nm) of the smallest-sized printing plate precursor.

Here, an error of a maximum of about 15 $\mu$m can arise at one of the positioning pins 202. (The imaginary line in FIG. 9 shows the correct position.)

In consideration thereof, when the large-sized printing plate precursor 200 is conveyed with the center as a reference and is positioned by abutting the pair of positioning pins 202, if the error is the maximum (15 $\mu$m), the following equation is established.

$$15\times10^{-3}/380=x/(1160/2+380/2) \quad (1)$$

By varying the equation in order to obtain x, the equation becomes $$x=15\times10^{-3}\times(1160/2+380/2)/380 \quad (2)$$

Carrying out computation results in $$x\approx30.4\ \mu\text{m} \quad (3)$$

If the pair of positioning pins 202 were disposed at a pitch of 650 mm, carrying out the same computation would result in a value of about 20.9 $\mu$m.

From this, it can be understood that the larger the ratio of the pitch dimension P of the pair of positioning pins 202 with respect to the transverse direction size W of the printing plate precursor (W/P<1), the better the precision.

However, it becomes extremely complicated when more than one pair of positioning pins is aligned on the same line. When the line connecting the axes of the positioning pins meanders (zigzags), it conversely becomes a cause of deterioration of the positioning accuracy of printing plate precursors of respective sizes. Further, because the edges of the printing plate precursor itself are not necessarily rectilinear, it is desirable to provide a pair of pins at a pitch which is optimal for all sizes.

SUMMARY OF THE INVENTION

In view of the aforementioned, an object of the present invention is to provide a sheet-shaped material positioning device which, with a simple structure, can position sheet-shaped materials from large sizes to small sizes, and which can suppress errors to a range of errors which is allowable at the time of positioning large- and small-sized printing plate precursors.

A first aspect of the present invention is a sheet-shaped material positioning device which has a conveying path, and which positions a sheet-shaped material conveyed in a predetermined direction along the conveying path, and which is able to convey sheet-shaped materials of different widths with respect to a conveying direction, the sheet-shaped material positioning device comprising: a moving mechanism for moving a sheet-shaped material along the conveying direction; a first group of pins for abutting sheet-shaped material of a size having a first nominal width, which first group of pins is disposed on the conveying path; and a second group of pins for abutting sheet-shaped material of a size having a second nominal width, which second group of pins is disposed on the conveying path, wherein at least one pin of the first group of pins is disposed downstream, relative to the conveying direction, of the second group of pins, and the moving mechanism moves the sheet-shaped material and makes a front edge of the sheet-shaped material abut either of the first group of pins and the second group of pins.

In accordance with the first aspect of the present invention, the first and second nominal widths are used as representative values (typical values), and by providing positioning pins, i.e., a pin group, corresponding to each size which has been classified on the basis of the representative values (typical values), the positioning error can be kept to within an allowable range. Moreover, at least one positioning pin of the first group of pins is offset, in the conveying direction of the sheet-shaped material, with respect to the second group of pins. Therefore, it suffices for accuracy to be provided in units of groups of positioning pins.

In the first aspect of the present invention, it is generally preferable that a ratio of the first nominal width to an interval between pins belonging to the first group of pins is substantially equal to a ratio of the second nominal width to an interval between pins belonging to the second group of pins.

Due to such a structure, positioning pins which are disposed in accordance with the respective sizes of the sheet-shaped materials are provided. For each size of sheet-shaped material, errors in positioning arising at the time when the sheet-shaped material is positioned can be kept to within an allowable range.

Namely, with regard to the widths of the sheet-shaped materials, the ratio (proportion) of the interval (pitch) between the positioning pins of the one group of positioning pins for large-sized sheet-shaped materials and the typical transverse direction dimension of a large-sized sheet-shaped material (the second nominal width), and the ratio of the interval between the positioning pins of the one group of positioning pins for small-sized materials and the typical transverse direction dimension of a small-sized sheet-shaped material (the first nominal width), are substantially equal. In this way, even if there are errors within the allowable range, the errors can be kept to within substantially the same range for both groups of large-sized and small-sized sheet-shaped materials, and the errors can be kept to the same extent.

Further, it suffices for the accuracy to be maintained in units of the groups of positioning pins, and there is no need to consider the relative positional relationship with other positioning pins (with positioning pins for sheet-shaped materials of other sizes). The workability at the time of assembly is therefore improved.

The moving mechanism may convey sheet-shaped materials of different widths such that transverse direction centers of the sheet-shaped materials substantially coincide, and the first group of pins and the second group of pins may be disposed such that a central point of the first group of pins and a central point of the second groups of pins are positioned substantially at the transverse direction centers of the sheet-shaped materials.

In a case in which the sheet-shaped material is positioned by using the center in the direction orthogonal to the conveying direction as a reference, i.e., by using the center in the transverse direction as a reference, the groups of positioning pins of the respective sizes, i.e., the pairs of positioning pins, can be disposed independently of one another. Namely, the interval (pitch) between the positioning pins of the pair of positioning pins for large-sized sheet-shaped materials is made to be larger than the width of small-sized sheet-shaped materials, and the pair of positioning pins for small-sized sheet-shaped materials is offset toward the conveying direction downstream side. In this way, the small-sized sheet-shaped materials can abut the pair of positioning pins for small-sized sheet-shaped materials, without contacting the pair of positioning pins for large-sized sheet-shaped materials.

Further, in the first aspect, the first group of pins and the second group of pins may have one pin in common, and the moving mechanism may convey, in the conveying direction, sheet-shaped materials having different widths such that side edges of the sheet-shaped materials, at a side at which the common pin is disposed, coincide.

In a case in which the sheet-shaped material is positioned by using a transverse direction end portion (a side edge) as a reference, one positioning pin of the positioning pins for the respective sizes is used in common. In this case, the positioning pins which are not used in common are offset from one another. The sheet-shaped materials of the respective sizes which are in their positioned states have different inclinations (degrees of tilting) with respect to the conveying direction. In this case, if, for example, the processing of the subsequent step is a processing for recording an image on the sheet-shaped material on the basis of an image signal, these differences in the inclinations can be addressed by adjusting the image signals.

A second aspect of the present invention is a sheet-shaped material positioning device which has a conveying path, and which positions a sheet-shaped material conveyed in a predetermined direction along the conveying path, and which is able to convey sheet-shaped materials of different widths with respect to a conveying direction, the sheet-shaped material positioning device comprising: a first pair of pins disposed on the conveying path at a predetermined interval in a direction intersecting the conveying direction; a second pair of pins disposed on the conveying path at a predetermined interval in the direction intersecting the conveying direction; and a moving mechanism for moving a sheet-shaped material along the conveying direction, and for making a front edge of the sheet-shaped material abut either of the first pair of pins and the second pair of pins, wherein the interval between the pins belonging to the first pair of pins is shorter than the interval between the pins belonging to the second pair of pins, and the first pair of pins is disposed downstream, relative to the conveying direction, of the second pair of pins so as to be separated from the second pair of pins by a given distance, and due to a sheet-shaped material of a size having a first nominal width being moved and a front edge thereof abutting the first pair of pins, the sheet-shaped material of the size having the first nominal width can be positioned, and due to a sheet-shaped material of a size having a second nominal width being moved and a front edge thereof abutting the second pair of pins, the sheet-shaped material of the size having the second nominal width can be positioned.

A third aspect of the present invention is a printing plate precursor exposure device for recording, by exposing a printing plate precursor, an image on a surface of the printing plate precursor, the printing plate precursor exposure device comprising: a supporting stand on which a printing plate precursor is disposed; a cylindrical drum having a peripheral surface and holding the printing plate precursor at the peripheral surface and being able to rotate, the cylindrical drum having, at the peripheral surface, a first pair of pins disposed at a predetermined interval in an axial direction of the cylindrical drum and a second pair of pins disposed at a predetermined interval in the axial direction of the cylindrical drum; and a moving mechanism for conveying the printing plate precursor, which is disposed on the supporting stand, toward the cylindrical drum, and making a leading edge of the printing plate precursor abut either one pair of pins among the first pair of pins and the second pair of pins, wherein the interval between the pins belonging to the first pair of pins is smaller than the interval between the pins belonging to the second pair of pins, and the first pair of pins is disposed downstream, relative to the conveying direction, of the second pair of pins so as to be separated from the second pair of pins by a given distance, and due to a printing plate precursor of a size having a first nominal width being moved and a front edge thereof abutting the first pair of pins, the printing plate precursor of the size having the first nominal width can be positioned, and due to a printing plate precursor of a size having a second nominal width being moved and a front edge thereof abutting the second pair of pins, the printing plate precursor of the size having the second nominal width can be positioned.

DESCRIPTION OF THE PREFERRED EMBODIMENTS

Figure 1:
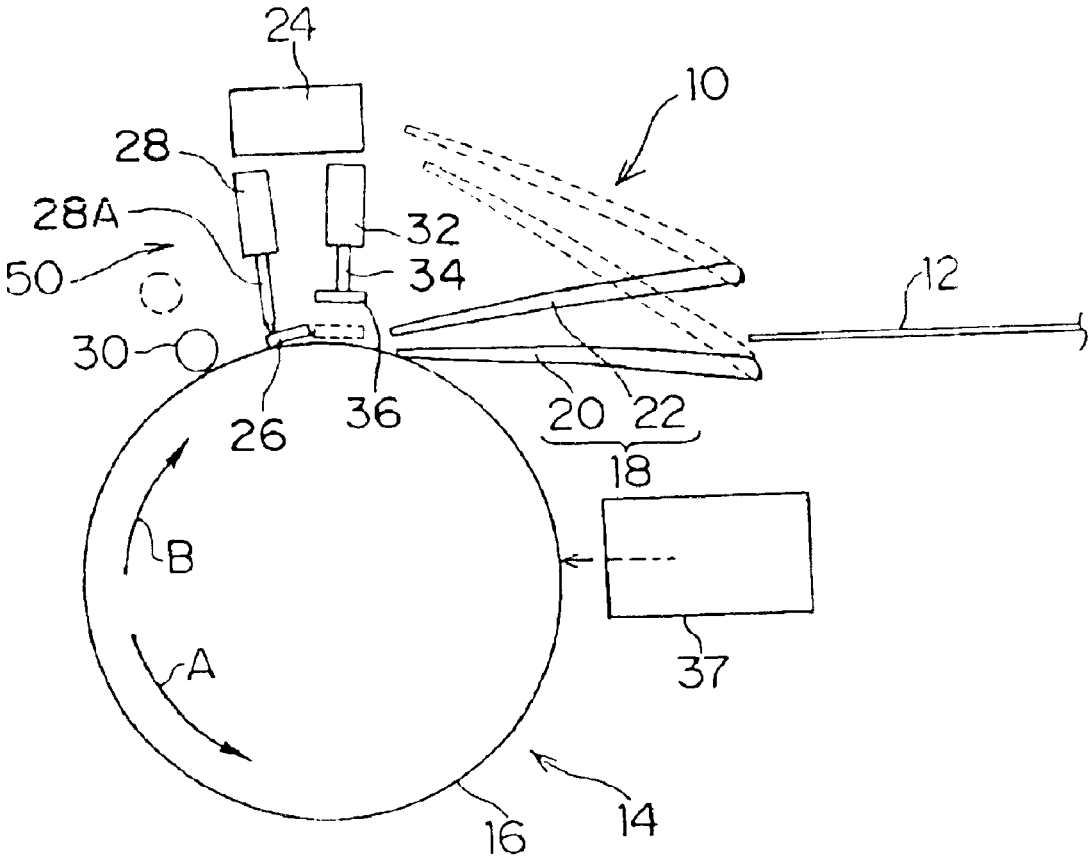
FIG. 1 is a schematic diagram of an automatic printing plate precursor exposure device relating to embodiments of the present invention.

An automatic printing plate precursor exposure device 10 relating to embodiments of the present invention is shown in FIG. 1.

The automatic printing plate precursor exposure device 10 is divided into two main sections which are an exposure section 14 which irradiates a light beam onto an image forming layer of a printing plate precursor 12 so as to expose an image thereon, and a conveying guide unit 18 which conveys the printing plate precursor 12 to the exposure section 14. Further, the printing plate precursor 12, which has been subjected to exposure processing, is fed out by the automatic printing plate precursor exposure device 10 to a developing device (unillustrated) which is disposed adjacent to the automatic printing plate precursor exposure device 10.

A rotating drum 16, around whose peripheral surface the printing plate precursor 12 is trained and held, forms the main portion of the exposure section 14. The printing plate precursor 12 is guided by the conveying guide unit 18, and is fed in from a direction tangential to the rotating drum 16. The conveying guide unit 18 is formed by a plate supplying guide 20 and a plate discharging guide 22.

The plate supplying guide 20 and the plate discharging guide 22 of the conveying guide unit 18 are disposed relatively so as to form a sideways V shape. The plate supplying guide 20 supplies the printing plate precursor 12 to the rotating drum 16, and the plate discharging guide 22 receives the printing plate precursor 12 from the rotating drum 16 (plate supplying/discharging positions).

A puncher 24 is disposed in a vicinity of the conveying guide unit 18. Here, the conveying guide unit 18 is structured so as to be able to pivot over a predetermined angle, with a vicinity of the right end portion thereof in FIG. 1 being the center of pivoting. Due to this pivoting, the conveying guide unit 18 can be selectively moved between the aforementioned plate supplying/discharging position (refer to the solid lines in FIG. 1), and a punch position (refer to the chain lines in FIG. 1) at which the printing plate precursor 12 is fed in from the plate supplying guide 20 to the puncher 24 and at which the printing plate precursor 12 is returned to the plate supplying guide 20 after punching.

Namely, as needed, the printing plate precursor 12 is first guided by the plate supplying guide 20 and fed-in toward the puncher 24, and holes or notches for positioning are formed in the leading end of the printing plate precursor 12. Thereafter, the printing plate precursor 12 is returned to the plate supplying guide 20. Thereafter, by pivoting the conveying guide unit 18, the plate supplying guide 20 is moved to the position corresponding to the rotating drum 16.

The rotating drum 16 is rotated by an unillustrated driving means in a printing plate precursor 12 attaching/exposing direction (the direction of arrow A in FIG. 1), and in a printing plate precursor 12 removing direction 12 (the direction of arrow B in FIG. 1) which is opposite to the attaching/exposing direction.

Leading end chucks 26 are mounted to a predetermined position of the outer peripheral surface of the rotating drum 16 provided in the exposure section 14. When the printing plate precursor 12 is to be attached to the rotating drum 16, first, the rotating drum 16 is stopped at the time when the leading end chucks 26 have reached a position (the printing plate precursor attaching position) corresponding to the leading end of the printing plate precursor 12 which has been fed in by the plate supplying guide 20 of the conveying guide unit 18.

A plurality of the leading end chucks 26 are provided along the axial direction of the rotating drum 16 and are aligned in one row. The leading end chucks 26 can each pivot in a seesaw-like manner.

A chuck opening/closing unit 28 is provided at the periphery of the rotating drum 16 so as to oppose the leading end chucks 26.

Extending/retracting rods 28A are provided at the chuck opening/closing unit 28. When the extending/retracting rods 28A are in extended states, the leading end chucks 26 are in a state in which the printing plate precursor 12 can be inserted in. When the extending/retracting rods 28A are in retracted states, the leading end chucks 26 are in a state in which they nip the printing plate precursor 12.

When the leading end of the printing plate precursor 12 is fixed to the rotating drum 16, the rotating drum 16 is rotated in the attaching/exposing direction. In this way, the printing plate precursor 12, which has been fed-in from the plate supplying guide 20 of the conveying guide unit 18, is taken-up onto the peripheral surface of the rotating drum 16.

A squeeze roller 30 is provided at the downstream side, in the attaching/exposing direction, of the printing plate precursor attaching position, in a vicinity of the peripheral surface of the rotating drum 16. Due to the squeeze roller 30 being moved toward the rotating drum 16, the printing plate precursor 12 which is trained on the rotating drum 16 is pressed toward the rotating drum 16 and is scraped tightly thereagainst. In this way, the printing plate precursor 12 is made to fit tightly to the peripheral surface of the rotating drum 16.

In the exposure section 14, a trailing end chuck attaching/removing unit 32 is disposed upstream side, in the attaching/exposing direction of the rotating drum 16, of the squeeze roller 30 (i.e., in a vicinity of the upstream side of the leading end chucks 26 relative to the attaching/exposing direction of the rotating drum 16). At the trailing end chuck attaching/removing unit 32, trailing end chucks 36 are attached to the distal ends of shafts 34 which project toward the rotating drum 16.

When the trailing end of the printing plate precursor 12 which is trained around the rotating drum 16 reaches the position opposing the trailing end chuck attaching/removing unit 32, the shafts 34 are made to project, and the trailing end chucks 36 are attached to predetermined positions of the rotating drum 16. In this way, the trailing end of the printing plate precursor 12 is nipped and held between the trailing end chucks 36 and the rotating drum 16.

At the exposure section 14, when the leading end and the trailing end of the printing plate precursor 12 are held at the rotating drum 16, the squeeze roller 30 is moved away. Thereafter, at the exposure section 14, while rotating the rotating drum 16 at high speed at a predetermined rotational speed, a light beam, which is modulated on the basis of image data, is irradiated from a recording head portion 37 synchronously with the rotation of the rotating drum 16. In this way, the printing plate precursor 12 is scan-exposed on the basis of the image data.

In the exposure section 14, when scan-exposure of the printing plate precursor 12 is completed, the rotating drum 16 is temporarily stopped at a position opposing the trailing end chuck attaching/removing unit 32. The trailing end chucks 36, which are holding the trailing end of the printing plate precursor 12, are removed from the rotating drum 16. In this way, the trailing end of the printing plate precursor 12 is freed.

Thereafter, by rotating the rotating drum 16 in the direction of removing the printing plate precursor 12, the printing plate precursor 12 is discharged, from the trailing end side thereof, to the plate discharging guide 22 along a direction tangential to the rotating drum 16, and thereafter, is conveyed to the developing device which is the subsequent process.

Figure 2:
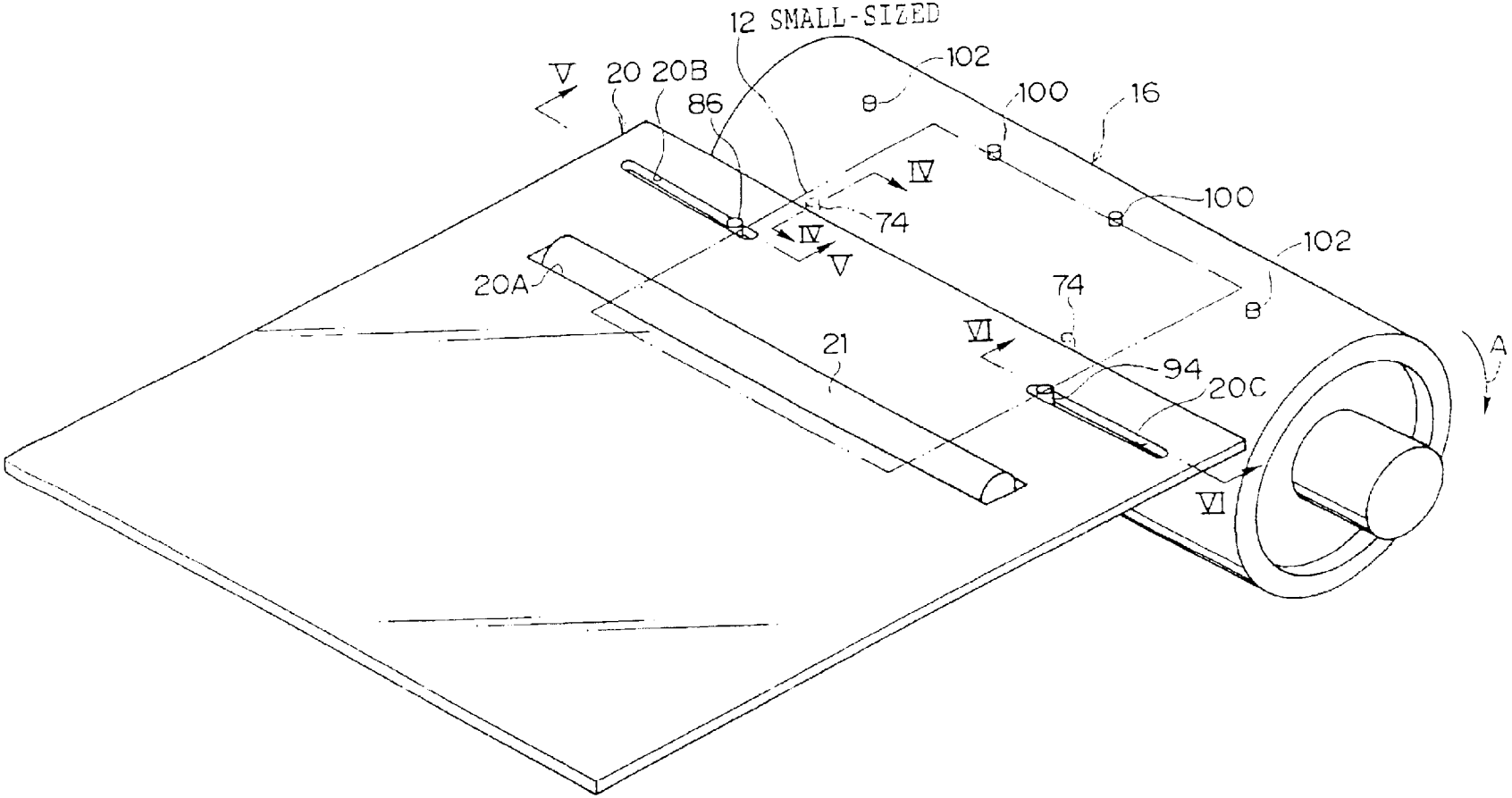
FIG. 2 is a perspective view of a conveying guide unit in a case in which a plate discharging guide is removed, where a small-sized printing plate precursor is shown by the imaginary lines.
Figure 3:
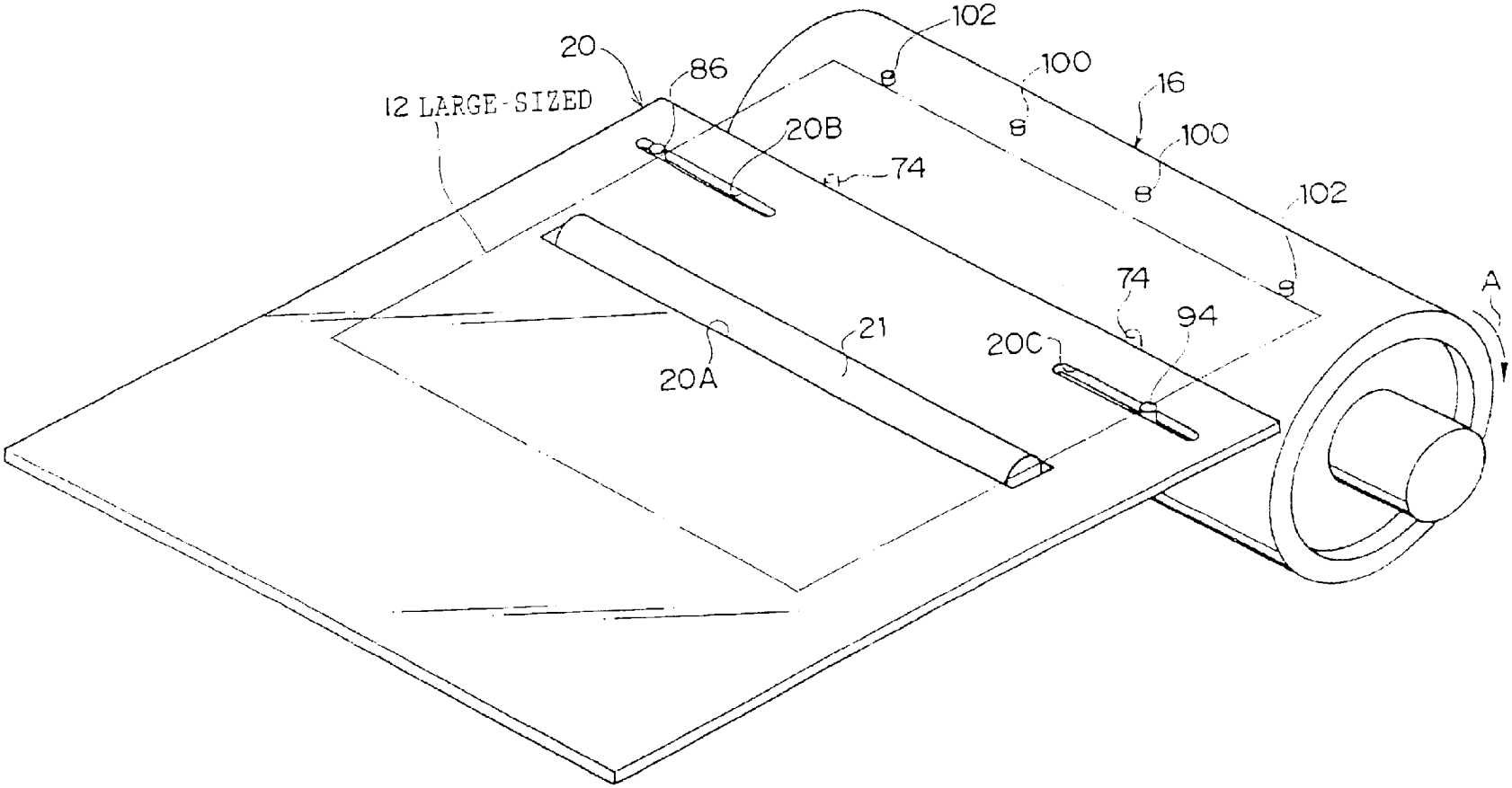
FIG. 3 is a perspective view of the conveying guide unit in a case in which the plate discharging guide is removed, where a large-sized printing plate precursor is shown by the imaginary lines.

The conveying guide unit 18, which is in a state in which the plate discharging guide 22 has been removed therefrom (i.e., which is in a state in which only the plate supplying guide 20 is attached) is shown in FIGS. 2 and 3.

A slit-shaped rectangular hole 20A is formed in the plate supplying guide 20. A portion of the peripheral surface of a driving roller 21 projects out further upwardly than the surface of the plate supplying guide 20, on which surface the printing plate precursor 12 is placed.

Further, a pair of positioning pins 74, which can project and withdraw with respect to the surface of the plate supplying guide 20, are provided at the rotating drum 16 side end portion of the plate supplying guide 20.

Figure 4:
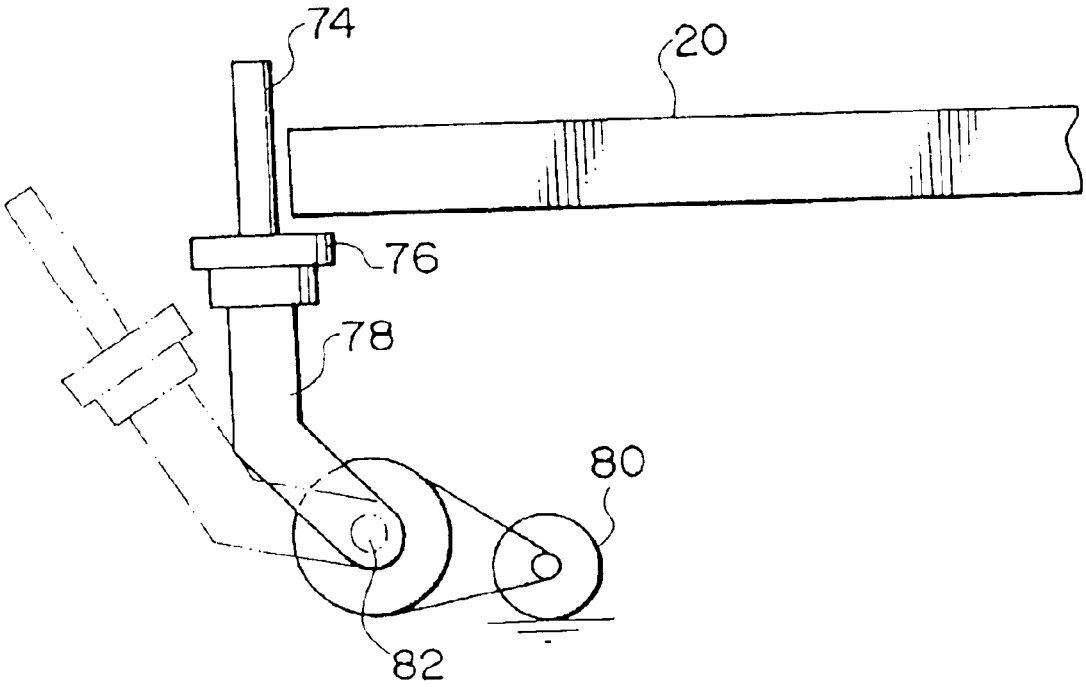
FIG. 4 is a cross-sectional view taken along line IV—IV of FIG. 2.

As shown in FIG. 4, the positioning pin 74 is mounted to a supporting bar 76 which is disposed along the side of the rotating drum 16 side end portion of the plate supplying guide 20. The supporting bar 76 is supported at one end portion of a substantially L-shaped arm 78.

The other end of the arm 78 is mounted to a rotating shaft 82 which rotates due to the driving force of a motor 80. Due to the rotating shaft 82 rotating, the arm 78 moves in a circular arc shape, and can be positioned at a projecting position (the position shown by the solid lines in FIG. 4) at which the positioning pin 74 projects up further than the surface of the plate supplying guide 20, and a withdrawn position (the position shown by the chain lines in FIG. 4) at which the positioning pin 74 is withdrawn beneath the surface of the plate supplying guide 20.

Further, a pushing pin 86, which is movable along the axial direction of the rotating drum 16, is provided at one end portion in the transverse direction of the plate supplying guide 20 (the left side end portion in FIGS. 2 and 3).

Figure 5:
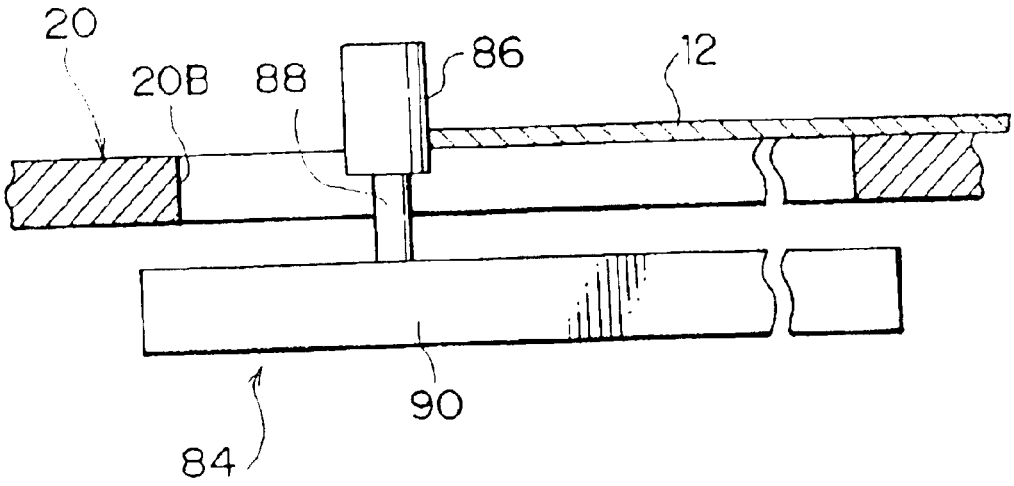
FIG. 5 is a cross-sectional view taken along line V—V of FIG. 2.

As shown in FIG. 5, the pushing pin 86 provided so as to project out at the surface (the top surface) of the plate supplying guide, and a supporting shaft 88 which rotatably supports the pushing pin 86, form a transverse direction pusher unit 84. The supporting shaft 88 passes through a slit 20B formed in the plate supplying guide 20, and passes through the reverse surface (bottom surface) side of the plate supplying guide 20.

As shown in FIG. 2 and FIG. 3, the slit 20B extends in the axial direction of the rotating drum 16. In this way, the pushing pin 86 (and the transverse direction pusher unit 84)

can move parallel to the axial direction of the rotating drum 16, along the slit 20B of the plate supplying guide 20.

The transverse direction pusher unit 84 is provided with a moving mechanism portion 90 (see FIG. 5). The pushing pin 86 moves, due to spring force, so as to follow the moving mechanism portion 90 which moves the pushing pin 86. Thus, due to the amount of expansion/contraction of the spring, errors between the amount of movement of the moving mechanism portion 90 and the actual amount of movement of the printing plate precursor 12 can be offset.

As shown in FIG. 2 and FIG. 3, a positioning pin 94, which is movable along the axial direction of the rotating drum 16, is provided at the other transverse direction end portion of the plate supplying guide 20 (the right side end portion in FIGS. 2 and 3).

Figure 6:
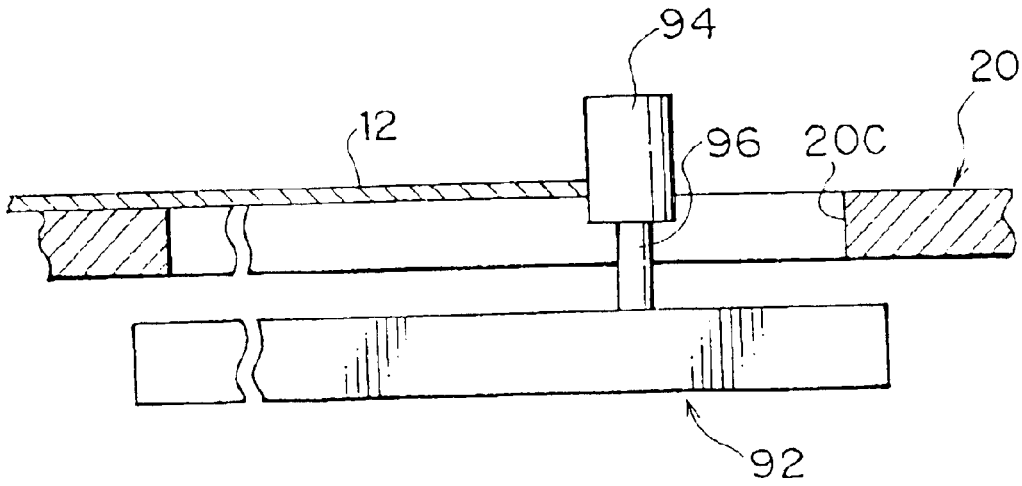
FIG. 6 is a cross-sectional view taken along line VI—VI of FIG. 2.

As shown in FIG. 6, the positioning pin 94 which is provided so as to project out from the surface (top surface) of the plate supplying guide 20, and a supporting shaft 96 which rotatably supports the positioning pin 94, form a positioning pin unit 92. The supporting shaft 96 passes through a slit 20C formed in the plate supplying guide 20, and passes through the reverse surface (bottom surface) side of the plate supplying guide 20.

As shown in FIG. 2 and FIG. 3, the positioning pin 94 can move parallel to the axial direction of the rotating drum 16, along the slit 20C of the plate supplying guide 20, and is disposed at a predetermined position in accordance with the size of the printing plate precursor 12. Here, the positioning pin 94 is positioned in advance such that the transverse direction centers of printing plate precursors 12 of all sizes coincide.

When the printing plate precursor 12 is nipped by the leading end chucks 26 of the rotating drum 16, the leading end surface of the printing plate precursor 12 abuts one pair of two pairs of positioning pins 100, 102 which are provided so as to project at predetermined positions at the peripheral surface of the rotating drum 16. The one pair of positioning pins 100 and the one pair of positioning pins 102 are provided so as to be offset in the peripheral direction. In the present embodiment, the one pair of positioning pins 102 is provided so as to be offset closer to the plate supplying guide 20, in the state in which the rotating drum 16 is stopped at the position at which it receives the printing plate precursor 12.

Figure 7:
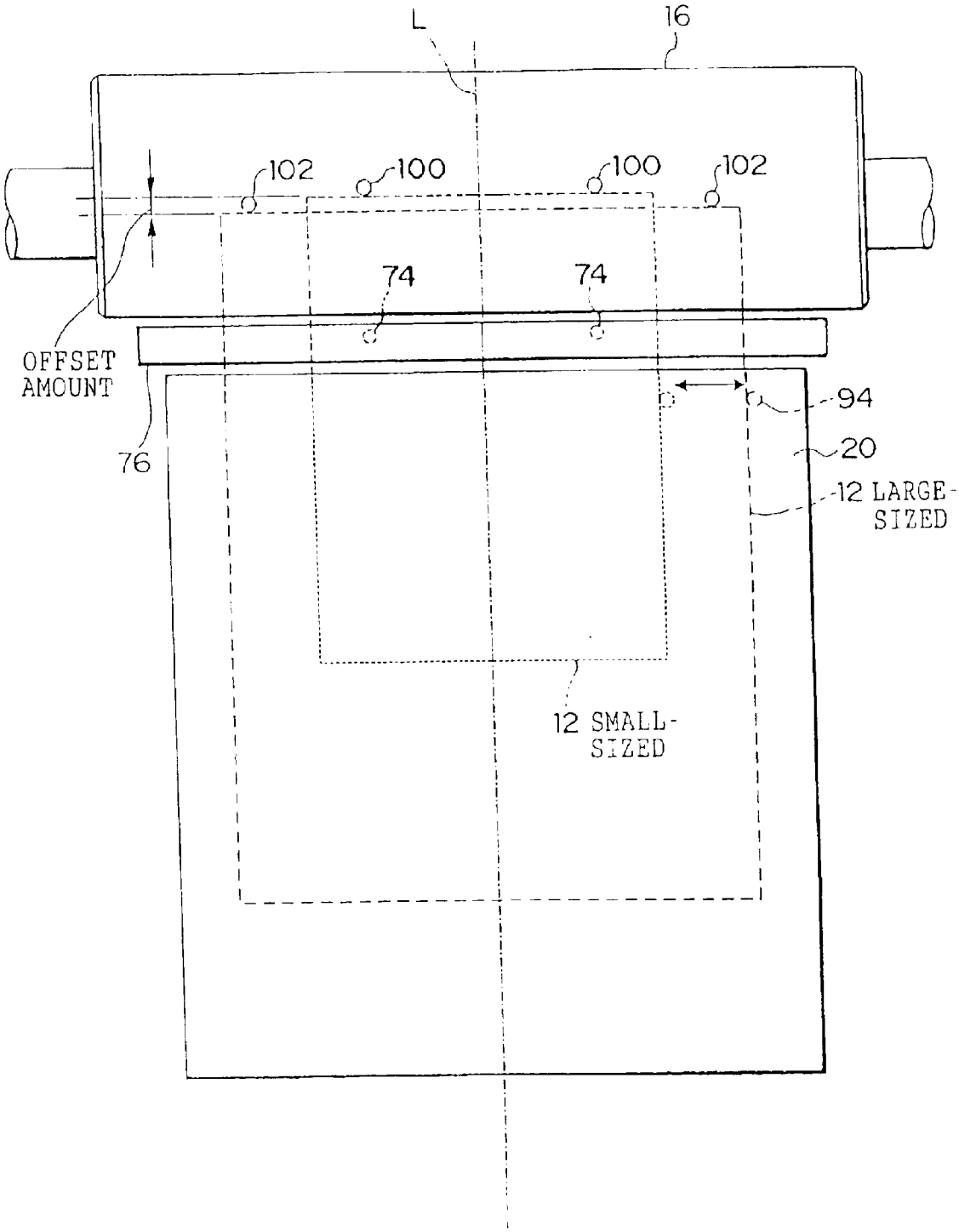
FIG. 7 is a plan view of a plate supplying guide relating to the embodiments and the periphery thereof, and illustrates an arrangement of positioning pins.

Namely, as shown in FIG. 7, a small-sized printing plate precursor 12 is positioned by abutting the one pair of positioning pins 100, and a large-sized printing plate precursor 12 is positioned by abutting the one pair of positioning pins 102, such that the pairs of positioning pins 100, 102 do not interfere with one another.

Here, to describe the positioning on the rotating drum 16 in further detail, in the state in which the printing plate precursor 12 is placed on the plate supplying guide 20, the driving roller 21 is driven, and the printing plate precursor 12 is made to abut the pair of positioning pins 74 which are positioned at their projecting positions. In this way, the tilting of the printing plate precursor 12 is substantially corrected. Further, in this state, the printing plate precursor 12 is moved in the transverse direction until it abuts the positioning pin 94. Thereafter, the positioning pins 74, which are positioned at their projecting positions, are withdrawn to their withdrawn positions.

In this state, by again moving the printing plate precursor 12 toward the rotating drum 16 by the driving of the driving roller 21, the printing plate precursor 12 abuts either the pair of positioning pins 100 or the pair of positioning pins 102 provided at the rotating drum 16. At this time, because the pair of positioning pins 100 or the pair of positioning pins 102 abuts the printing plate precursor 12, the position and the tilting of the leading end of the printing plate precursor 12 are positioned accurately on the rotating drum 16.

Because the transverse direction position of the printing plate precursor 12 is determined by the positioning pin 94, the relative positions of the rotating drum 16 and the printing plate precursor 12 are also determined thereby.

Operation of the present embodiment will be described hereinafter.

First, the printing plate precursor 12 is placed on the plate supplying guide 20. At this time, the printing plate precursor 12 may be placed on the plate supplying guide 20 by so-called manual feeding, or by being fed-in by an automatic printing plate precursor feeding device or the like.

The printing plate precursor 12, which is placed on the plate supplying guide 20, is supported such that the placement position, the tilting with respect to the feeding direction, and the like thereof are relatively rough (there are few constraints thereon). By driving the driving roller 21 in this state, the printing plate precursor 12 is moved to a vicinity of a predetermined temporary positioning position.

While the printing plate precursor 12 is being conveyed to the rotating drum 16, the positioning pins 74, which are provided at the rotating drum 16 side end portion of the plate supplying guide 20, are positioned at their projecting positions. Therefore, the printing plate precursor 12 abuts the positioning pins 74 and is temporarily positioned.

When the conveying direction position of the printing plate precursor 12 is determined, next, by moving the pushing pin 86 of the transverse direction pusher unit 84, the printing plate precursor 12 abuts the positioning pin 94, which is disposed in advance at a predetermined position on the basis of the size of the printing plate precursor 12, such that temporary positioning of the printing plate precursor 12 in the transverse direction is carried out.

In this temporarily positioned state, the positioning pins 74, which are at their projecting positions, are moved to their withdrawn positions. Thereafter, the driving roller 21 is driven such that the printing plate precursor 12 is moved toward the rotating drum 16, and the printing plate precursor 12 abuts the pair of positioning pins 100 or the pair of positioning pins 102 provided at the rotating drum 16. In this way, the position and the tilting of the leading end of the printing plate precursor 12 are corrected.

Here, in the present embodiment, the two pairs of positioning pins 100, 102 are disposed so as to be offset in the conveying direction. Namely, the positioning pins 100 for a small-sized plate are disposed further forward, in the conveying direction, than the positioning pins 102 for a large-sized plate.

By providing such a relative positional relationship, at the time when a small-sized printing plate precursor 12 is conveyed, when a transverse direction central line L (see FIG. 7) coincides, as the reference position for transverse direction positioning, with the center of the printing plate precursor, the printing plate precursor 12 can directly abut the pair of positioning pins 100 for a small-sized plate and be positioned, because the width of the small-sized printing plate precursor 12 is smaller than the pitch dimension of the pair of positioning pins 102 for a large-sized plate.

On the other hand, when a large-sized printing plate precursor 12 is conveyed, because the printing plate precursor 12 first abuts the pair of positioning pins 102 for a large-sized plate and is positioned, the existence of the pair of positioning pins 100 for a small-sized plate does not affect the printing plate precursor 12.

Note that the transverse direction position of the printing plate precursor 12 is determined by the positioning pin 94. In this way, the position of the printing plate precursor 12 with respect to the rotating drum 16 is determined unconditionally.

The printing plate precursor 12, which has been fed to the rotating drum 16 and has been positioned, is trained tightly around the peripheral surface of the rotating drum 16 by the leading end chucks 26 and the trailing end chucks 36 (refer to FIG. 1), such that preparations for exposure are completed.

Image data is read, and exposure processing by the light beam from the recording head portion 37 is started. The exposure processing is so-called scan-exposure in which the recording head portion 37 is moved in the axial direction of the rotating drum 16 while the rotating drum 16 is rotated at high speed (main scanning).

When exposure processing has been completed, the printing plate precursor 12 which is trained around the rotating drum 16 is discharged out in a direction tangential to the rotating drum 16, and is fed to the plate discharging guide 22.

When the printing plate precursor 12 is fed to the plate discharging guide 22, the printing plate precursor 12 is then discharged out therefrom in order to proceed to the subsequent process. The developing section is provided as the destination to which the printing plate precursor 12 is discharged, and the printing plate precursor 12 is then subjected to developing processing thereat.

In accordance with the present embodiment, the printing plate precursors 12 are classified into large-sized printing plate precursors 12 and small-sized printing plate precursors 12, and the pairs of positioning pins 100, 102 are provided on the rotating drum 16 in correspondence with these respective sizes. The pair of positioning pins 100, which corresponds to the small-sized printing plate precursors 12, is disposed so as to be offset by a given distance toward the downstream side in the direction of conveying the printing plate precursors 12 to the rotating drum 16. The pitch dimension of the pair of positioning pins 100 (the interval between the pins) is set to be smaller than the pitch dimension of the pair of positioning pins 102 for large-sized plates. Due to such a structure, the small-sized printing plate precursors 12 can be positioned by abutting the positioning pins 100 for small-sized plates which are further forward, and the large-sized printing plate precursors 12 can be positioned by directly abutting the positioning pins 102 for large-sized plates, without being interfered with by the positioning pins 100 for small-sized plates.

As a result, large-sized and small-sized printing plate precursors 12 can be positioned by the pairs of positioning pins 100, 102 which have sufficient intervals, i.e., which have sufficiently wide pitches, corresponding to the respective sizes. Further, errors in positioning can be suppressed to within an allowable range.

Figure 8:
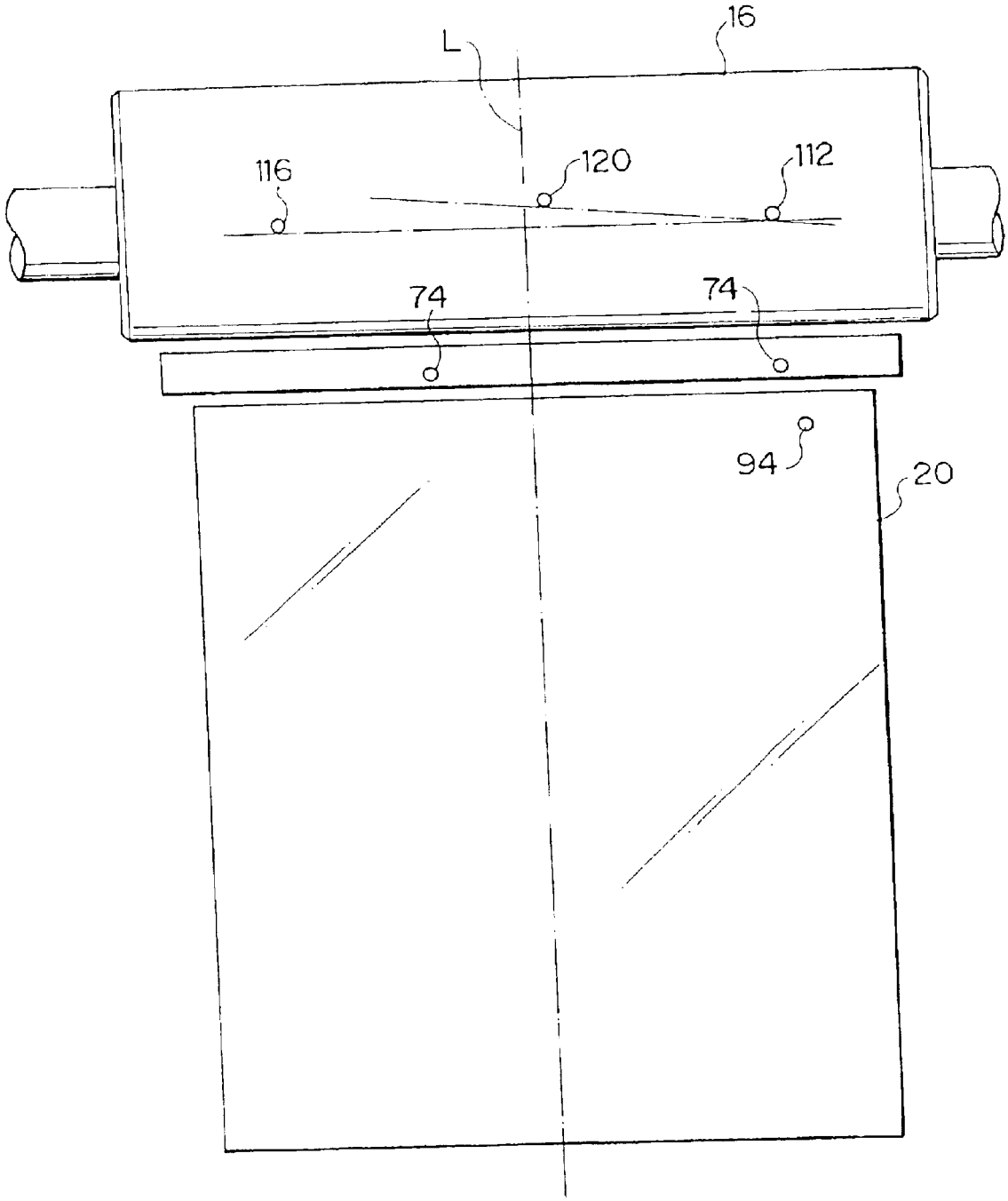
FIG. 8 is a plan view of the plate supplying guide and the periphery thereof, and illustrates an arrangement of positioning pins relating to a modified example.
Figure 9:
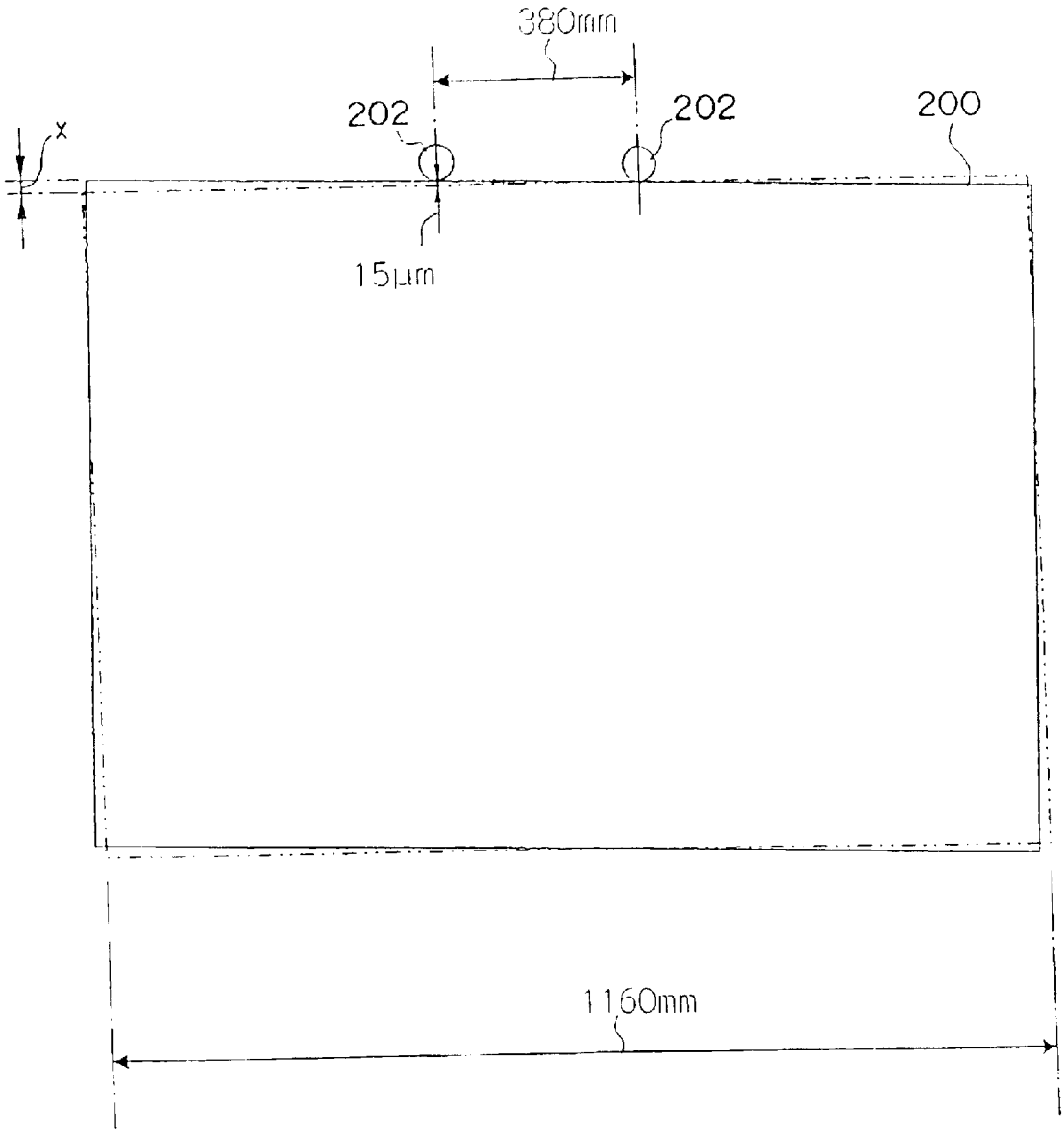
FIG. 9 is a plan view of a printing plate precursor, and illustrates a positioned state in a conventional example.

Note that the present embodiment was described based on the assumption that the printing plate precursor 12 is conveyed by using the transverse direction central line thereof as a reference. However, as shown in FIG. 8, even in a case in which the printing plate precursor 12 is conveyed by using one transverse direction end portion as a reference, the same effects can be achieved by slightly changing the arrangement of the positioning pins. Namely, as shown in FIG. 8, a positioning pin 112, which is near to the one end portion which is the reference for transverse direction positioning of the printing plate precursor 12, is used in common. A positioning pin 116 for large-sized plates and a positioning pin 120 for small-sized plates, which respectively form a pair with this common positioning pin 112, are offset from one another.

In this case, when both large-sized and small-sized printing plate precursors 12 are positioned, although the tilting thereof with respect to the conveying direction is different, the amount of tilting may be corrected at the device which feeds the image signal.

Further, in the present embodiment, the printing plate precursors 12 are classified into two types which are small-sized and large-sized, and the two pairs of positioning pins 100, 102 are provided. However, the number of classifications of sizes of the printing plate precursors 12 is not limited to two, and the printing plate precursors 12 may be classified into three or more types. It suffices to increase the number of positioning pins forming pairs in accordance with the number of classified types of printing plate precursors 12.

Figure 10:
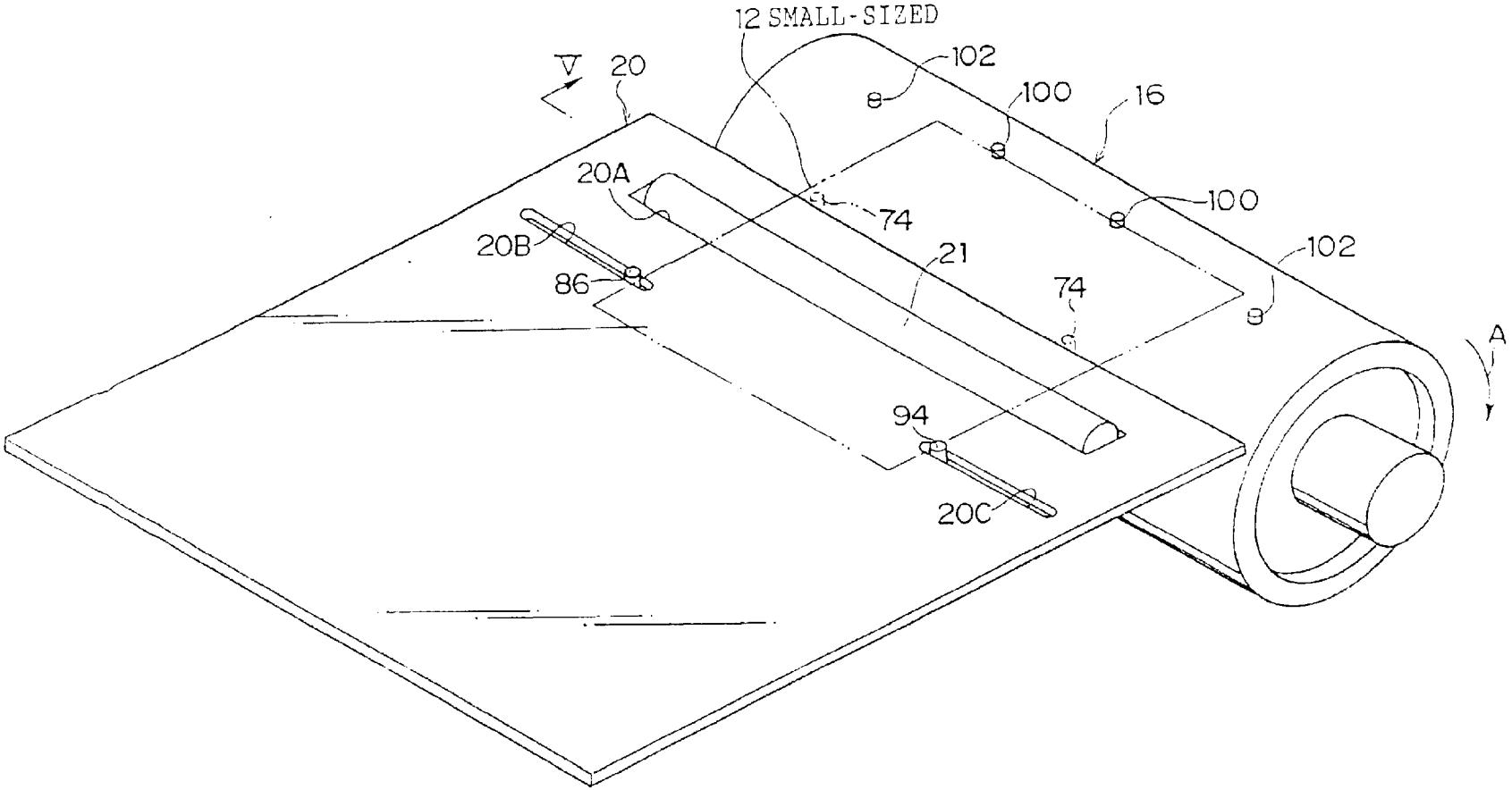
FIG. 10 is a perspective view of the conveying guide unit in a case in which the plate discharging guide is removed, and relates to a modified example of FIG. 2, where a printing plate precursor corresponding to a small size is shown by the imaginary lines.
Figure 11:
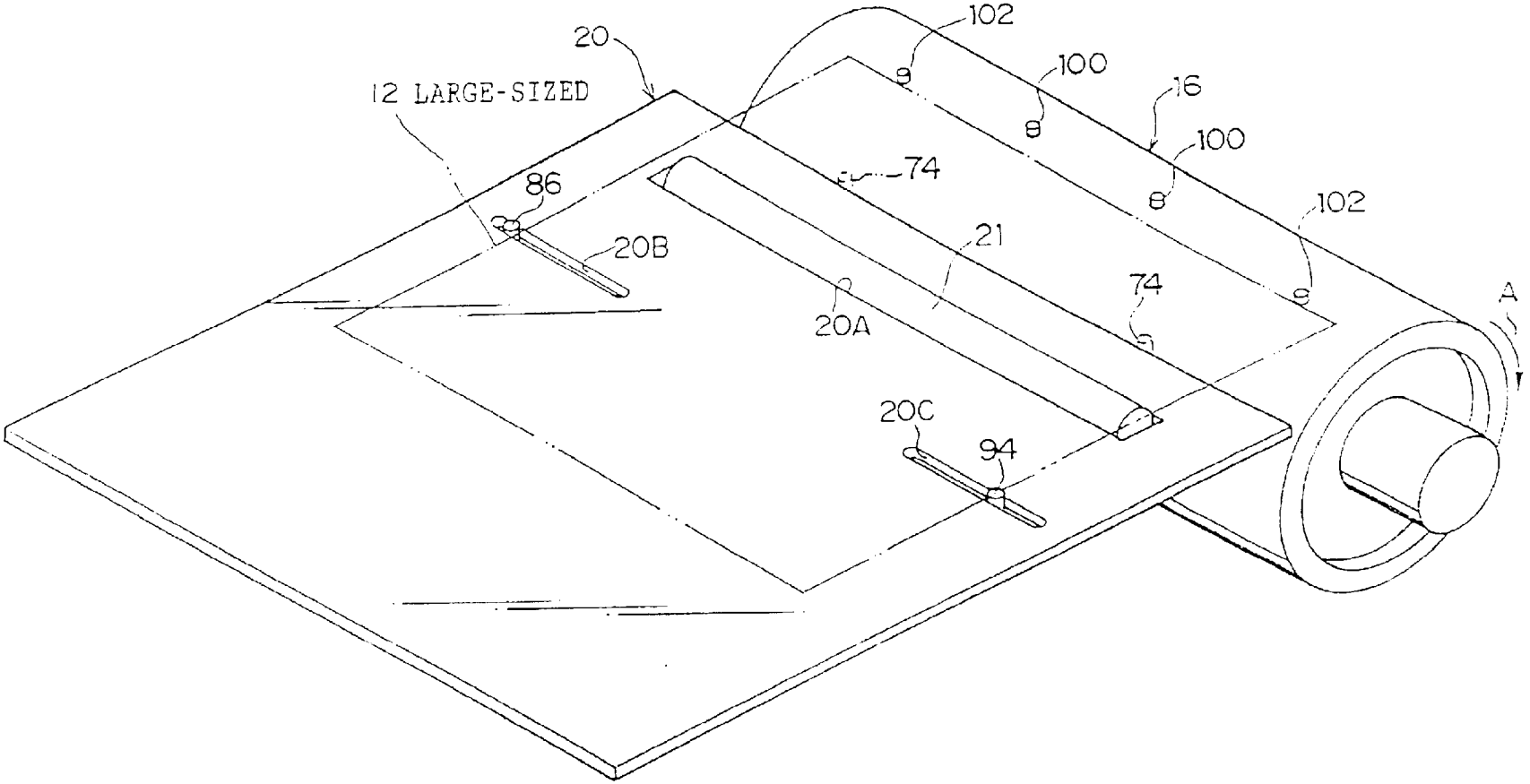
FIG. 11 is a perspective view of the conveying guide unit in a case in which the plate discharging guide is removed, and relates to a modified example of FIG. 3, where a printing plate precursor corresponding to a large size is shown by the imaginary lines.

In the above-described embodiment, as shown in FIG. 2 and FIG. 3, the slit-shaped rectangular hole 20A is provided at the printing plate precursor conveying direction upstream side of the slit 20C of the plate supplying guide 20, and a portion of the peripheral surface of the driving roller 21 projects further upward than the surface of the plate supplying guide 20 on which the printing plate precursor 12 is placed. However, as shown in FIGS. 10 and 11, the rectangular hole 20A may be provided at the conveying direction downstream side of the slit 20C, and a portion of the peripheral surface of the drive roller 21 may project from this rectangular hole 20A.

As described above, the present invention has the excellent effect that, with a simple structure, sheet-shaped materials of a wide range of sizes from large sizes to small sizes can be positioned, and regardless of whether the sheet-shaped material is large-sized or small-sized, errors in positioning the sheet-shaped material can be suppressed to a fixed range of errors which is allowable at the time of positioning the sheet-shaped materials.

What is claimed is:

1. A sheet-shaped material positioning device which has a conveying path, and which positions a sheet-shaped material conveyed in a predetermined direction along the conveying path, and which is able to convey sheet-shaped materials of different widths with respect to a conveying direction, the sheet-shaped material positioning device comprising:

a moving mechanism for moving a sheet-shaped material along the conveying direction;

a first group of pins for abutting sheet-shaped material of a size having a first nominal width, which first group of pins is disposed on the conveying path; and a second group of pins for abutting sheet-shaped material of a size having a second nominal width, which second group of pins is disposed on the conveying path, wherein at least one pin of the first group of pins is disposed downstream, relative to the conveying direction, of the second group of pins, and the moving mechanism moves the sheet-shaped material and makes a front edge of the sheet-shaped material abut either of the first group of pins and the second group of pins, wherein a ratio of the first nominal width to an interval between the pins belonging to the first group of pins is substantially equal to a ratio of the second nominal width to an interval between the pins belonging to the second group of pins.

2. The positioning device of claim 1, wherein the first group of pins and the second group of pins hove one pin in common, and the moving mechanism conveys, in the conveying direction, sheet-shaped materials, which have different widths, such that side edges of the sheet-shaped materials, at a side at which the common pin is disposed, coincide.

3. A sheet-shaped material positioning device which has a conveying path, and which positions a sheet-shaped material conveyed in a predetermined direction along the conveying path, and which is able to convey sheet-shaped materials of different widths with respect to a conveying direction, the sheet-shaped material positioning device comprising:

a first pair of pins disposed on the conveying path at a predetermined interval in a direction intersecting the conveying direction;

a second pair of pins disposed on the conveying path at a predetermined interval in the direction intersecting the conveying direction; and a moving mechanism for moving a sheet-shaped material along the conveying direction, and for making a front edge of the sheet-shaped material abut either of the first pair of pins and the second pair of pins, wherein the interval between the pins belonging to the first pair of pins is shorter than the interval between the pins belonging to the second pair of pins, and the first pair of pins is disposed downstream, relative to the conveying direction, of the second pair of pins so as to be separated from the second pair of pins by a given distance, and due to a sheet-shaped material of a size having a first nominal width being moved and a front edge thereof abutting the first pair of pins, the sheet-shaped material of the size having the first nominal width can be positioned, and due to a sheet-shaped material of a size having a second nominal width being moved and a front edge thereof abutting the second pair of pins, the sheet-shaped material of the size having the second nominal width can be positioned wherein a ratio of the first nominal width to the interval between the pins belonging to the first pair of pins is substantially equal to a ratio of the second nominal width to the interval between the pins belonging to the second pair of pins.

4. The positioning device of claim 3, wherein the first pair of pins and the second pair of pins are disposed substantially orthogonal to the conveying direction.

5. The positioning device of claim 3, wherein the moving mechanism conveys sheet-shaped materials of different widths such that transverse direction centers of the sheet-shaped materials substantially coincide, and the first pair of pins and the second pair of pins are disposed such that a central point of the first pair of pins and a central point of the second pair of pins are positioned substantially at the transverse direction centers of the sheet-shaped materials.

6. The positioning device of claim 3, wherein the sheet-shaped material is a printing plate precursor.

7. The positioning device of claim 3, further comprising a drum having a cylindrical peripheral surface and providing a portion of the conveying path and being rotatable around an axis of the drum, wherein the first pair of pins and the second pair of pins are disposed at the cylindrical peripheral surface of the drum.

8. The positioning device of claim 3, wherein each of the first pair of pins and the second pair of pins is disposed along an axial direction of the drum.

9. A sheet-shaped material positioning device which has a conveying path, and which positions a sheet-shaped material conveyed in a predetermined direction along the conveying path, and which is able to convey sheet-shaped materials of different widths with respect to a conveying direction, the sheet-shaped material positioning device comprising:

a plurality of pins disposed at different positions on the conveying path, and forming a first group of pins and a second group of pins by respectively combining any two pins; and a sheet-shaped material moving mechanism for moving a sheet-shaped material along the conveying direction, and for making a front edge of the sheet-shaped material abut one of the first group of pins and the second group of pins, wherein an interval between the two pins of the first group of pins is smaller than an interval between the two pins of the second group of pins, and at least one of the pins of the first group of pins is disposed downstream, relative to the conveying direction, of at least one of the pins of the second group of pins, and due to a sheet-shaped material of a size having a first nominal width being moved and a front edge thereof abutting the first group of pins, the sheet-shaped material of the size having the first nominal width can be positioned, and due to a sheet-shaped material of a size having a second nominal width being moved and a front edge thereof abutting the second group of pins, the sheet-shaped material of the size having the second nominal width can be positioned wherein a ratio of the first nominal width to an interval between the pins belonging the first group of pins is substantially equal to a ratio of the second nominal width to an interval between the pins belonging to the second group of pins.

10. The positioning device of claim 9 wherein the sheet-shaped material is a printing plate precursor.

11. The positioning device of claim 9 further comprising a drum provided at the conveying path and having a cylindrical peripheral surface and being rotatable around an axis of the drum, wherein the first group of pins and the second group of pins are disposed at the cylindrical peripheral surface of the drum.

12. A printing plate precursor exposure device for recording, by exposing a printing plate precursor, an image on a surface of the printing plate precursor, the printing plate precursor exposure device comprising:

a supporting stand on which a printing plate precursor is disposed;

a cylindrical drum having a peripheral surface and holding the printing plate precursor at the peripheral surface and being able to rotate, the cylindrical drum having, at the peripheral surface, a first pair of pins disposed at a predetermined interval in an axial direction of the cylindrical drum and a second pair of pins disposed at a predetermined interval in the axial direction of the cylindrical drum; and a moving mechanism for conveying the printing plate precursor, which is disposed on the supporting stand, toward the cylindrical drum, and making a leading edge of the printing plate precursor abut either one pair of pins among the first pair of pins and the second pair of pins wherein the interval between the pins belonging to the first pair of pins is smaller than the interval between the pins belonging to the second pair of pins, and the first pair of pins is disposed downstream, relative to the conveying direction, of the second pair of pins so as to be separated from the second pair of pins by a given distance, and due to a printing plate precursor of a size having a first nominal width being moved and a front edge thereof abutting the first pair of pins, the printing plate precursor of the size having the first nominal width can be positioned, and due to a printing plate precursor of a size having a second nominal width being moved and a front edge thereof abutting the second pair of pins, the printing plate precursor of the size having the second nominal width can be positioned wherein the printing plate precursor has a side edge at each side with respect to the conveying direction, the supporting stand has a plurality of pin members which regulate and position the printing plate precursor with respect to a direction orthogonal to the conveying direction, and each pin member corresponds to one of the side edges of the printing plate precursor and determines a position of the printing plate precursor at the corresponding side edge.

13. The printing plate precursor exposure device of claim 12, wherein the supporting stand includes an opening, and the moving mechanism includes a roller, and a portion of a peripheral surface of the roller emerges out on the supporting stand from the opening and moves the printing plate precursor in the conveying direction.

14. The printing plate precursor exposure device of claim 12 wherein a position of the pin member corresponding to at least one side edge is determined in correspondence with one of the first and second nominal widths.

* * * * *